US005403200A

United States Patent [19]

Chen

[11] Patent Number: 5,403,200

[45] Date of Patent: Apr. 4, 1995

[54] ELECTRIC CONNECTING BLOCK

[76] Inventor: Michael Chen, No. 11, Alley 16, Lane 337, Sec. 1, Ta Tung Rd., Hsi Chin Chen, Taipei Hsien, Taiwan, Prov. of China

[21] Appl. No.: 237,934

[22] Filed: May 4, 1994

[51] Int. Cl.[6] ..... H01R 4/24

[52] U.S. Cl. ..... 439/404; 439/417; 439/676; 439/894

[58] Field of Search ..... 439/676, 395, 404, 405, 439/344, 638, 639, 709, 713–715

[56] References Cited

U.S. PATENT DOCUMENTS 4,850,887 7/1989 Sugawara ..... 439/108

5,186,647 2/1993 Denkmann et al. ..... 439/395

*Primary Examiner*—David L. Pirlot

*Attorney, Agent, or Firm*—Lowe, Price, LeBlanc & Becker

[57] ABSTRACT

An electric connecting block having a lead frame for interconnection of jack wires of a modular jack thereof with insulated telephone wires, the lead frame including a plurality of conductors disposed on the same plane with either two adjacent or non-adjacent conductors arranged into wire pairs, wherein the conductors have each an intermediate section made gradually thinner toward the modular jack, the intermediate sections of the conductors being obliquely extended toward a center line through said modular jack; either two adjacent conductors which form a wire pair have a respective triangularly curved segment vertically curved in reversed directions and bridging over each other with a space defined therebetween.

2 Claims, 8 Drawing Sheets

UTP Connecting Hardware Attenuation

| Frequency (MHz) | Category 3 (dB) | Category 4 (dB) | Category 5 (dB) |
|---|---|---|---|
| 1.0 | 0.4 | 0.1 | 0.1 |
| 4.0 | 0.4 | 0.1 | 0.1 |
| 8.0 | 0.4 | 0.1 | 0.1 |
| 10.0 | 0.4 | 0.1 | 0.1 |
| 16.0 | 0.4 | 0.2 | 0.2 |
| 20.0 | -- | 0.2 | 0.2 |
| 25 | -- | -- | 0.2 |
| 31.25 | -- | -- | 0.2 |
| 62.5 | -- | -- | 0.3 |
| 100 | -- | -- | 0.4 |

Fig,8

UTP Connecting Hardware NEXT Loss

| Frequency (MHz) | Category 3 (dB) | Category 4 (dB) | Category 5 (dB) |
|---|---|---|---|
| 1.0 | 58 | >65 | >65 |
| 4.0 | 46 | 58 | >65 |
| 8.0 | 40 | 52 | 62 |
| 10.0 | 38 | 50 | 60 |
| 16.0 | 34 | 46 | 56 |
| 20.0 | -- | 44 | 54 |
| 25 | -- | -- | 52 |
| 31.25 | -- | -- | 50 |
| 62.5 | -- | -- | 44 |
| 100 | -- | -- | 40 |

Fig.9

ELECTRIC CONNECTING BLOCK

TECHNICAL FIELD

The present invention relates to electric connecting block for interconnection of modular jack with insulated telephone wires, and more particularly to such an electric connecting block which keeps crosstalk, attenuation, and return loss maintained within a tolerable range.

BACKGROUND OF THE INVENTION

Various electric connecting blocks are known for use in telecommunications equipment to provide computers, modems and the like with access to communication cables. Exemplars of these electric connecting blocks are shown in U.S. Pat. No. 4,865,564 for wall mounted connecting block and U.S. Pat. No. 5,091,826 for printed wiring board connector (see FIG. 1). The wall mounted connecting block of U.S. Pat. No. 4,865,564 and the printed wiring board connector of U.S. Pat. No. 5,091,826 are designed for the same object of providing a design that is suited for automated assembly and quick replacement. These electric connecting blocks are functional however, they cannot match with the fast transmission speed of the latest generation of high-speed computers.

As shown in FIG. 1, the lead frame comprises 8 flat elongated conductive elements that individually interconnect one of jack wires with one of connectors. Each conductive element includes a narrow area for connection with one of connectors. This design will increase signal transmission loss when used in high frequency signal transmission. Furthermore, because the connective elements are arranged in parallel, the crosstalk between either pair of conductive elements becomes worse. In order to eliminate these problems, certain electronic components (such as capacitors) shall be installed in the electric circuit of the electric connecting block. However, these corrective measures greatly increase the manufacturing cost of the electric connecting block and its dimension. According to TIA/EIA made by ANSI, see FIG. 8 and FIG. 9, these corrective measures provide little improvement in transmission quality.

SUMMARY OF THE INVENTION

The present invention has been accomplished under the circumstances in view. It is therefore the major object of the present invention to provide an electric connecting block which eliminates the drawbacks of the aforesaid conventional electric connecting blocks. It is another object of the present invention to provide an electric connecting block which meets the TIA/EIA specifications.

According to the present invention, the conductors of the lead frame for interconnection of jack wires with insulated telephone wires are disposed on the same plane with either two adjacent or non-adjacent conductors arranged into wire pairs, wherein the conductors have each an intermediate section made gradually thinner toward the modular jack, the intermediate sections of the conductors being obliquely extended toward a center line through said modular jack; either two adjacent conductors which form a wire pair have a respective triangularly curved segment vertically curved in reversed directions and bridging over each other with a space defined therebetween. This arrangement keeps crosstalk, attenuation and return loss maintained within a tolerable range during signal transmission.

BRIEF DESCRIPTION OF THE DRAWINGS

FIG. 8 shows standards on UTP Connecting Hardware Attenuation;

FIG. 9 shows standards on UTP Connecting Hardware Next Loss.

DETAILED DESCRIPTION OF THE PREFERRED EMBODIMENT

Figure 1:
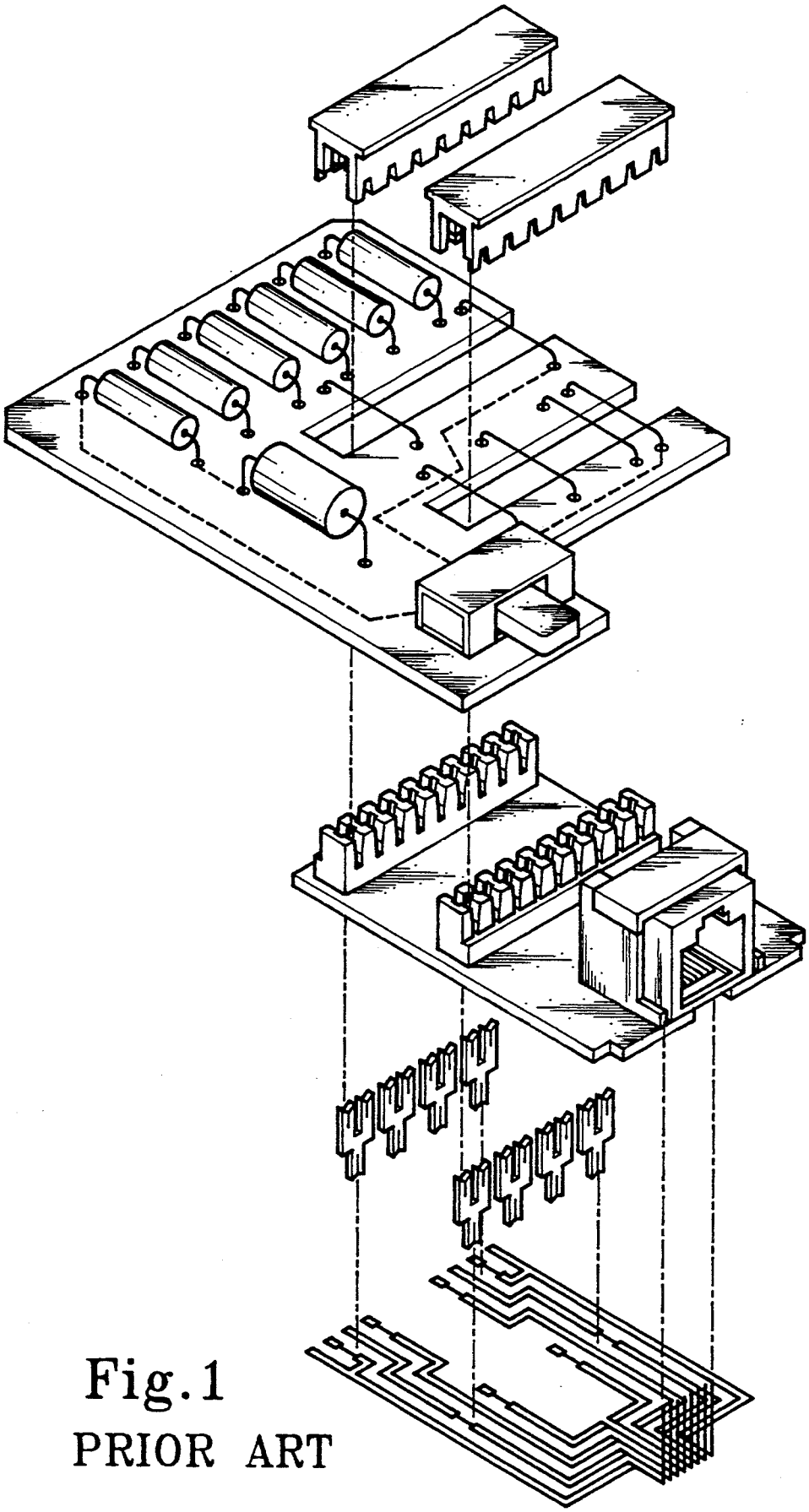
Fig. 1 PRIOR ART
FIG. 1 is an exploded view of the printed wiring board connector disclosed in U.S. Pat. No. 5,091,826.
Figure 2:
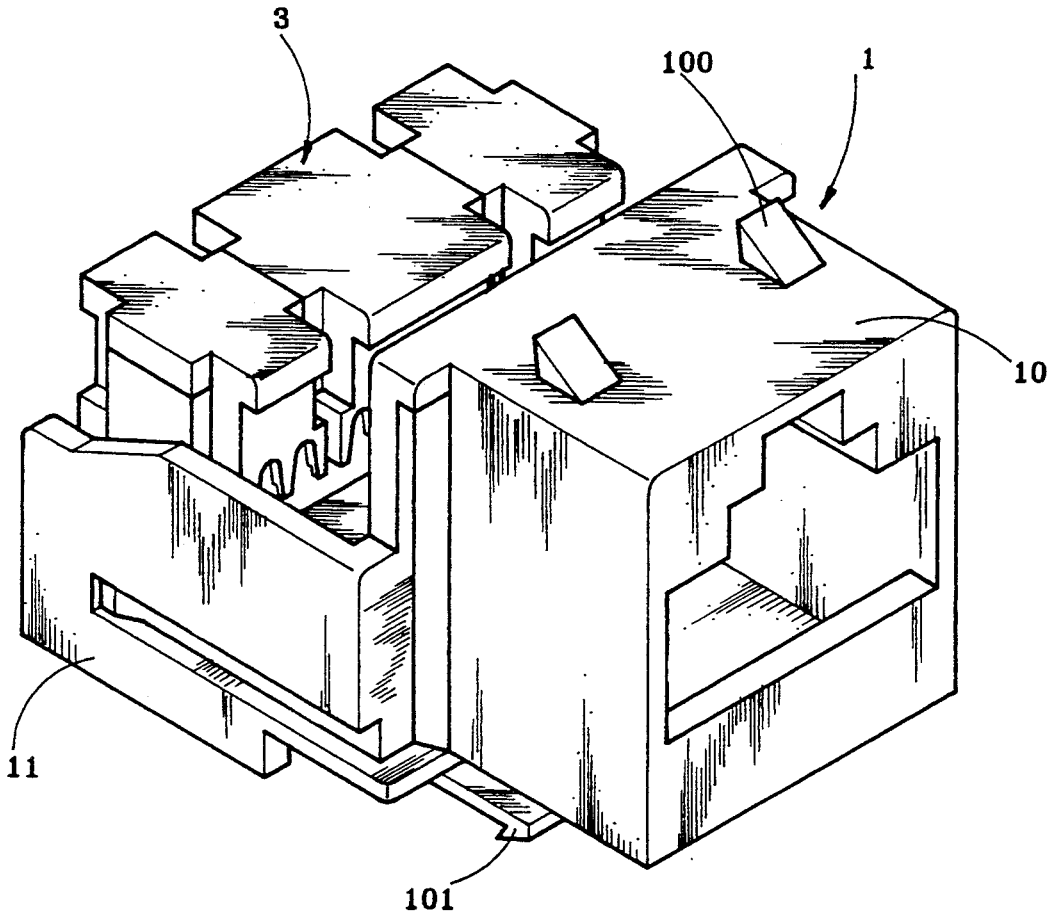
FIG. 2 is an elevational view of an electric connecting block according to the present invention.
Figure 3:
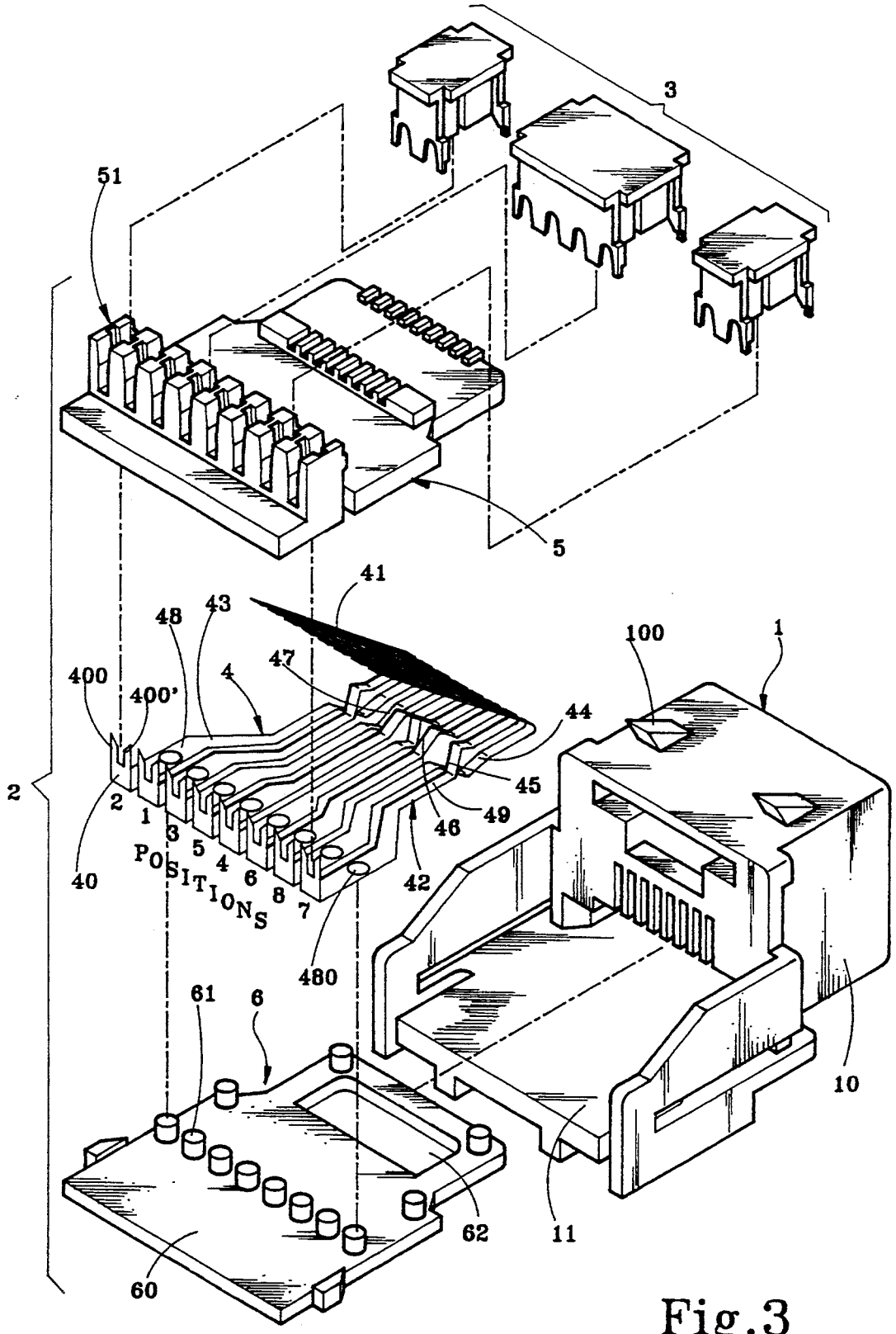
FIG. 3 is an exploded view of the electric connecting block shown it, FIG. 2.

Referring to FIGS. 2 and 3, an electric connecting block 1 in accordance with the present invention includes a modular jack 10, a base 11 backwards extended from the modular jack 10, a wire receiving unit 2 mounted on the base 11 to receive telephone wires, and a plurality of caps 3 mounted on the wire receiving unit 2 to hold down telephone wires. The modular jack 10 has a plurality of retaining blocks 100 at the top and a plurality of hooks 101 at the bottom for mounting within a hole on the wall or the panel of the telecommunication equipment.

The wire receiving unit 2 includes a 8-conductor lead frame 4 for interconnection of the modular jack 1 with the telephone wires, a bottom plate 6 and a cover 5 covered on the lead frame 4 at both sides. The 8-conductor lead frame 4 comprises eight upright connector portions 40 for receiving telephone wires, eight modular jack contact portions 41 respectively connected to the wires of the modular jack 10, and eight flat connecting portions 42 connected between the upright connector portions 40 and the modular jack contact portions 41 respectively. The upright connector portions 40 have each a forked edge 400;400' inserted into a respective wire-receiving slot 51 on the cover 5. When telephone wires are respectively put in the wire-receiving slots 51 and fixed in place by the caps 3, the forked edges 400;400' of the upright connector portions 40 respectively pierce the insulator or either telephone wire and make a respective contact. The eight flat connecting portions 42 have a respective front section 48 respectively extended from either upright connector portion 40 and disposed in parallel with one another, a respective rear section 49 respectively connected to either modular jack conductor 41 and disposed in parallel with one another, and a respective intermediate section 43 connected between the front section 48 and the rear section 49. The intermediate sections 43 of the eight flat connecting portions 42 are disposed on the same plane but not in parallel with one another. The intermediate sections 43 are respectively made gradually thinner toward the rear sections 49. Therefore, the flat connecting portions 42 are not disposed in parallel with one another. The front section 48 has a pin hole 480, which receives a respective upright pin 61 on the bottom plate 6 for positioning.

Figure 7A:
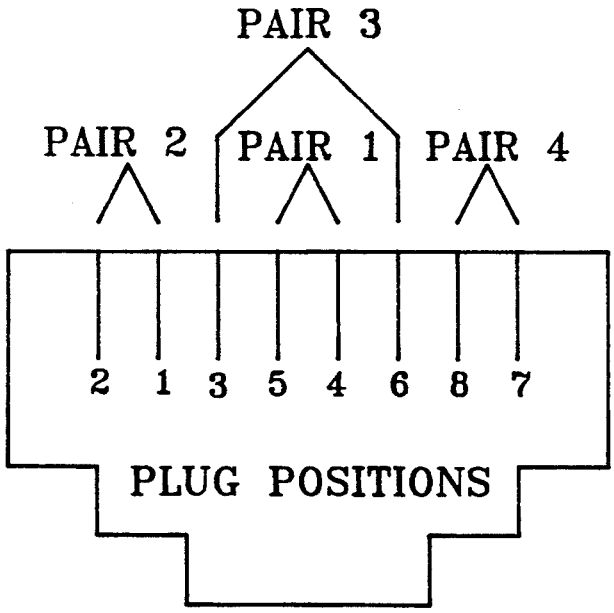
FIG. 7A shows the plug positions according to the present invention.
Figure 7B:
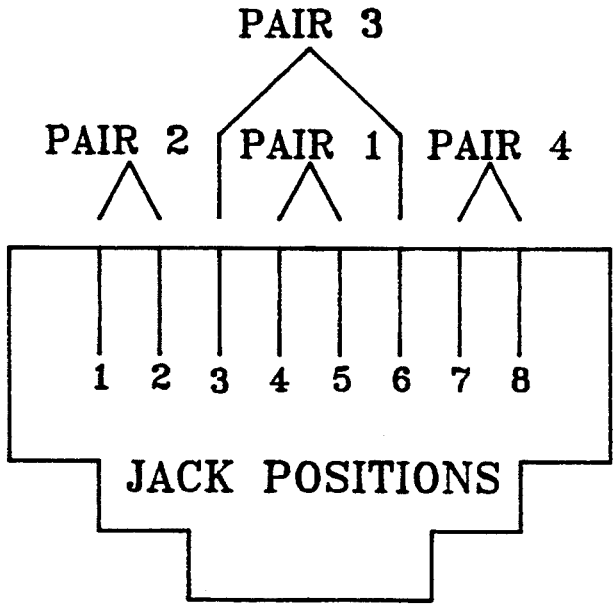
FIG. 7B shows the jack positions according to the present invention.

In order to match with the positions of the wire pairs of the modular jack as shown in FIG. 7B, the positions of the eight conductors of the eight-wire lead frame 4 must be properly arranged. As shown in FIG. 7A, the eight conductors of the eight-wire lead frame 4 are arranged into four wire pairs including pair 1 (positions 5;4), pair 2 (positions 2;1), pair 4 (positions 8;7), and pair 3 (positions 3;6).

Figure 6:
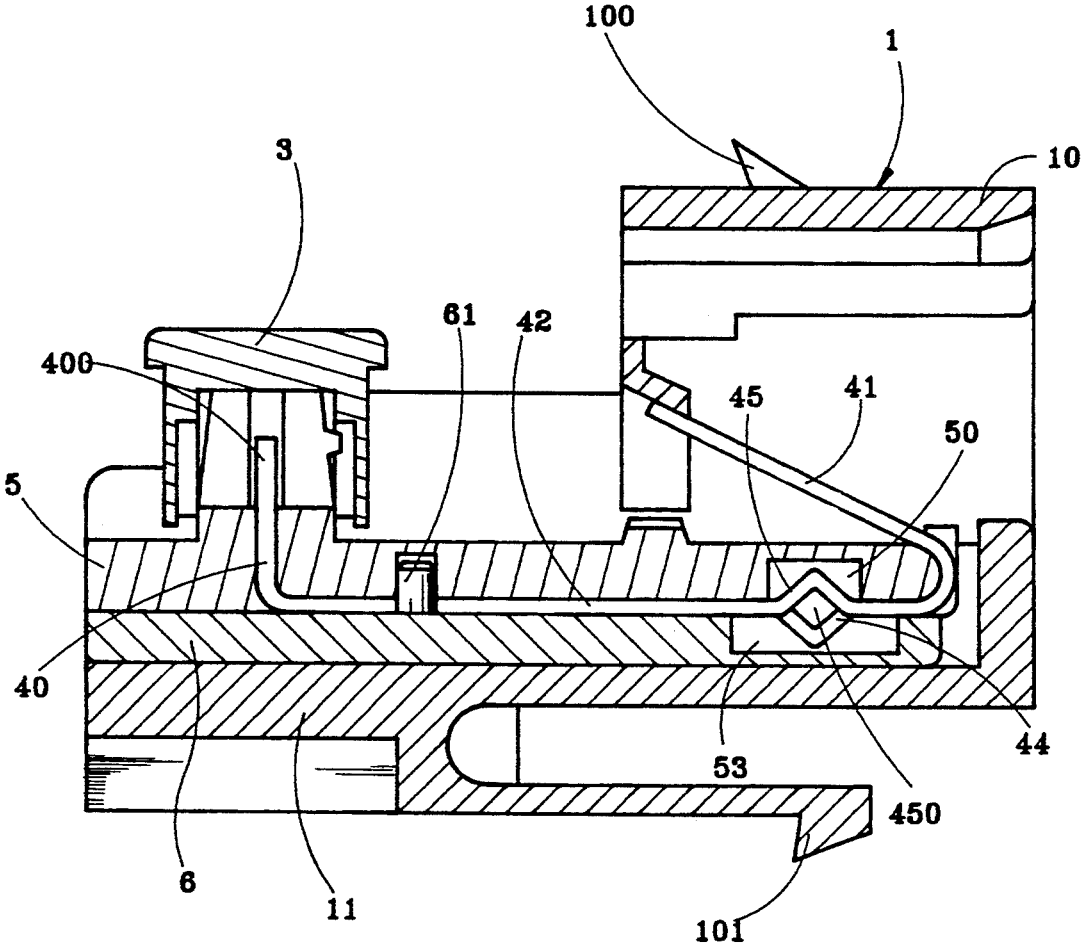
FIG. 6 is a sectional view of the electric connecting block shown in FIG. 2, showing the positions of the conductive elements.

Referring to FIG. 6, the rear sections 49 of either pair 1, pair 2, or pair 4 have each a triangularly curved segment 44 or 45 curving vertically in reversed directions and bridging over each other therefore, a space 450 is defined between the downwardly triangularly curved segment 44 and the upwardly triangularly curved segment 45. This arrangement allows the modular jack contact portions 41 of the pair 1, pair 2 and pair 4 to match with the wires of the modular jack 10.

The two non-adjacent conductors (positions 3;6) of the pair 3 of the lead frame 4 have a respective triangularly curved segment 46 or 47 on the respective rear section 49, wherein the segment 46 curves upward; the segment 47 curves downward. Because the segments 46;47 are spaced by the conductors of the pair 1, they do not bridge over each other.

The bridging design of the aforesaid triangularly curved segments 44;45 greatly reduces the level of crosstalk, attenuation and return loss during signal transmission. As shown in the annexed Text Report, the test results of the electric connecting block of the present invention are in conformity with TIA/EIA specifications.

Figure 4:
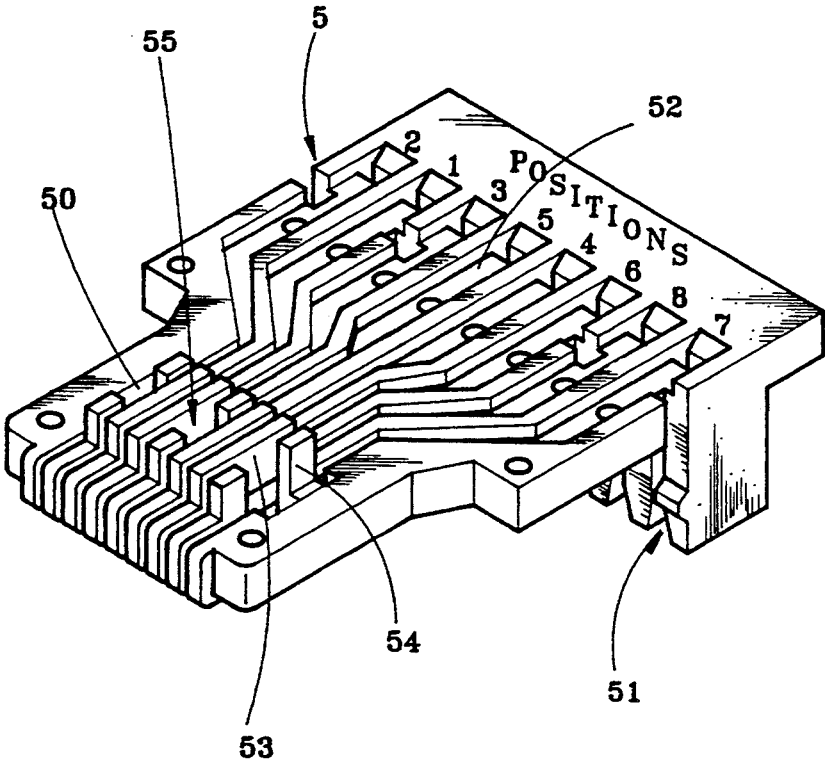
FIG. 4 shows the bottom side of the cover of the electric connecting block shown in FIG. 2.
Figure 5A:
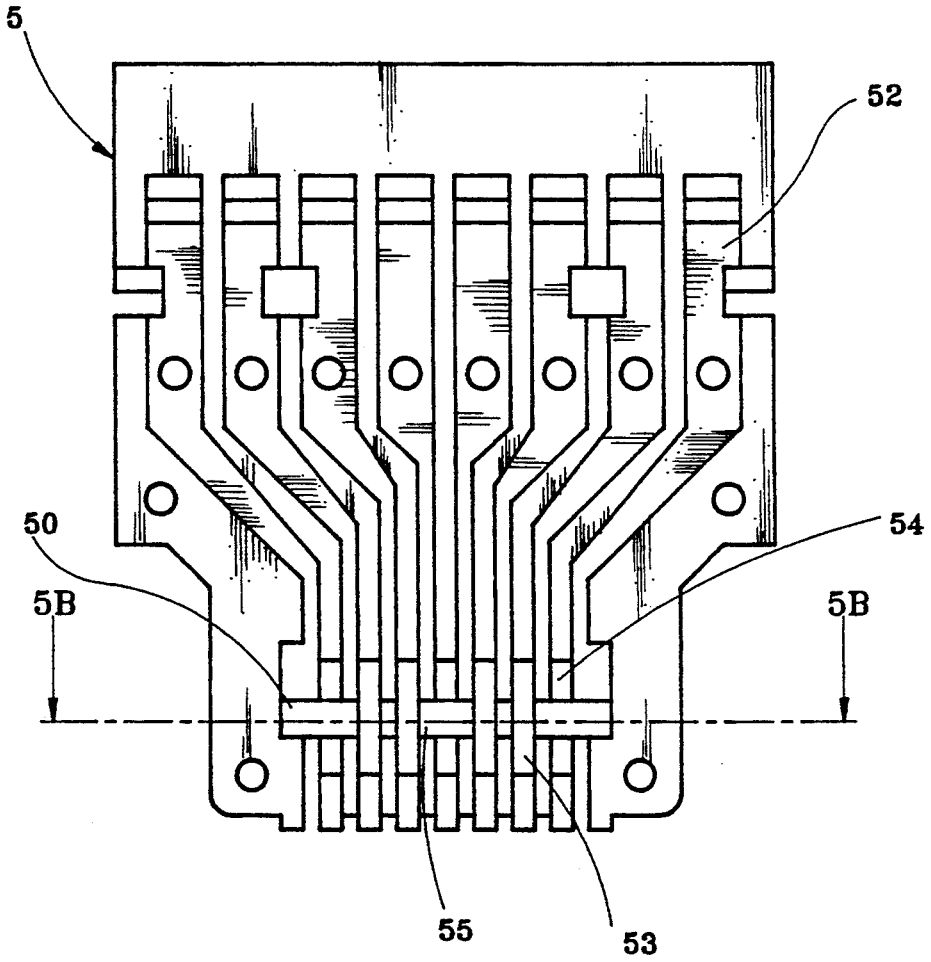
FIG. 5A is a front view of the cover shown in FIG. 4.
Figure 5B:
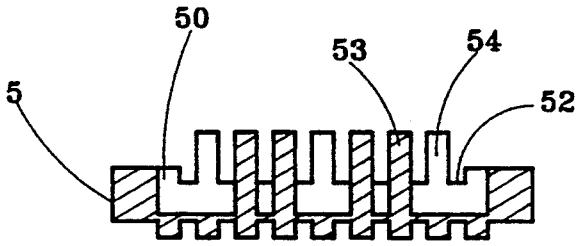
FIG. 5B is a cross sectional view of the cover shown in FIG. 4.

Referring to FIG. 4, the cover 5 comprises lead frame receiving slots 52, which receive the eight conductors of the lead frame 4, and a receiving space 50, which receives the segments 45;46. The bottom plate 6 has a plurality of upright pins 61 raised from a flat top wall 60 thereof and respectively fitted into the pin holes 480 on the lead frame 4, and a recessed hole 62 on the flat top wall 60 which receives the segments 44;47. The cover 5 further comprises first partition walls 53 and second partition walls 54 respectively inserted into the recessed hole 62 on the flat top wall 60 of the bottom plate 6. The first partition walls 53 separate the segments 46;47 from the segments 44;45. The second partition walls 54 define receiving gaps 55 for the segments 44;45 respectively.

I claim:

1. An electric connecting block comprising;.

a base with a modular jack;

a plurality of conductors for interconnection of jack wires of said modular jack with insulated telephone wires, said conductors being arranged into wire pairs matching with the wire pairs of said jack wires of said modular jack;

a bottom plate and a cover mounted on said base and covering over all wire pairs of said conductors at two opposite sides to isolate said conductors from one another;

wherein (i) said conductors each have an intermediate section made gradually thinner toward said modular jack, (ii) the intermediate sections of said conductors being obliquely extended toward a center line through said modular jack, (iii) two adjacent conductors which form a wire pair have a respective triangularly curved segment vertically curved in reversed directions and bridging over each other with a space defined therebetween, (iv) two non-adjacent conductors which form a wire pair have a respective triangularly curved segment vertically curved in reversed directions and are horizontally separated from each other, (v) said conductors each have an Upright connector portion at one end for connection with a respective telephone wire, a modular jack contact portion connected to either jack wire of said modular jack, and a flat connecting portion connected between said upright connector portion and said modular jack contact portion, said upright connector portion having a forked top edge for piercing the insulator of the respective telephone wire to make a respective contact, (vi) the triangularly curved segment of either conductor forms part of the flat connecting portion of the respective conductor; and (vii) said cover has a receiving space on a bottom wall thereof matching with a recessed hole on a top wall of said bottom plate to receive the triangularly curved segments of said conductors, and a plurality of receiving slots on the bottom wall thereof respectively linked to the receiving space thereof to receive the wire pairs of said conductors permitting the wire pairs to be separated from one another.

2. The electric connecting block of claim 1 wherein said cover further comprises a plurality of first partition walls and a plurality of second partition walls respectively inserted into said recessed hole on said bottom plate, said first partition walls separating the wire pairs of said conductors from one another, said second partition walls having gaps for passing the triangularly curved segments of either wire pair that bridges over each other.

* * * * *